US006631853B2

(12) United States Patent
Lenk et al.

(10) Patent No.: US 6,631,853 B2
(45) Date of Patent: Oct. 14, 2003

(54) OIL ACTIVATED FUEL INJECTOR CONTROL VALVE

(75) Inventors: Martin Lenk, Blythewood, SC (US); Bernd Niethammer, Blythewood, SC (US)

(73) Assignee: Siemens Diesel Systems Technologies, LLC, Blythewood, SC (US)

( * ) Notice: Subject to any disclaimer, the term of this patent is extended or adjusted under 35 U.S.C. 154(b) by 110 days.

(21) Appl. No.: 09/828,169

(22) Filed: Apr. 9, 2001

(65) Prior Publication Data

US 2002/0145056 A1 Oct. 10, 2002

(51) Int. Cl.[7] ..... F02M 47/02

(52) U.S. Cl. ..... 239/90; 239/88; 239/92; 239/96

(58) Field of Search ..... 239/88–96, 5, 239/124; 251/129.1; 137/625.65, 625.68, 247.13; 91/464

(56) References Cited

U.S. PATENT DOCUMENTS 4,182,492 A 1/1980 Albert et al.
4,406,307 A * 9/1983 Loup et al. ..... 137/625.65
5,359,976 A 11/1994 Nakashima et al.
5,454,359 A 10/1995 Howell
5,460,329 A * 10/1995 Sturman ..... 239/96
5,479,901 A 1/1996 Gibson et al.
5,640,987 A * 6/1997 Sturman ..... 137/625.65
5,878,720 A 3/1999 Anderson et al.
5,964,406 A 10/1999 Zuo
6,053,421 A 4/2000 Chockley
6,085,991 A * 7/2000 Sturman ..... 239/88
6,105,616 A 8/2000 Sturman et al.
6,119,960 A 9/2000 Graves
6,371,382 B1 * 4/2002 Niethammer et al. ..... 239/88

* cited by examiner

*Primary Examiner*—Michael Mar
*Assistant Examiner*—Dinh Q. Nguyen
(74) *Attorney, Agent, or Firm*—McGuireWoods LLP

(57) ABSTRACT

An oil activated fuel injector control valve which substantially eliminates captured air within working fluid of the fuel injector. This eliminates shot by shot variations in the fuel injector as well as increasing the efficiency of the fuel injector. The fuel injector includes a control valve body which has vent holes which prevent air from mixing with the working fluid. In this manner, the working fluid does not have to compress and/or dissolve the air in the working ports prior to acting on the piston and plunger mechanism in an intensifier body of the fuel injector.

27 Claims, 7 Drawing Sheets

OIL ACTIVATED FUEL INJECTOR CONTROL VALVE

BACKGROUND OF THE INVENTION

1. Field of the Invention

The present invention generally relates to an oil activated fuel injector and, more particularly, to an oil activated electronically or mechanically controlled fuel injector control valve which substantially eliminates captured air within working fluid of the fuel injector.

2. Background Description

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a control valve body may be provided with two, three or four way valve systems, each having grooves or orifices which allow fluid communication between working ports, high pressure ports and venting ports of the control valve body of the fuel injector and the inlet area. The working fluid is typically engine oil or other types of suitable hydraulic fluid which is capable of providing a pressure within the fuel injector in order to begin the process of injecting fuel into the combustion chamber.

It has been found in open systems that air becomes captured and locked within the grooves or orifices of the control valve (and a spool) during the venting of the working fluid during and at an end of a fuel injection cycle. This is mainly due to the fact that vent holes which surround the control valve body allow air to enter the system. This air will mix with the working fluid during the fuel injection process resulting in variations in fuel injection quantities. Of course, this will lead to inefficient shot to shot variations.

Being more specific, a driver will first deliver a current or voltage to an open side of an open coil solenoid. The magnetic force generated in the open coil solenoid will shift a spool into the open position so as to align grooves or orifices (hereinafter referred to as "grooves") of the control valve body and the spool. The alignment of the grooves permits the working fluid to flow into an intensifier chamber from an inlet portion of the control valve body (via working ports). The high pressure working fluid then acts on an intensifier piston to compress an intensifier spring and hence compress fuel located within a high pressure plunger chamber. As the pressure in the high pressure plunger chamber increases, the fuel pressure will begin to rise above a needle check valve opening pressure. At the prescribed fuel pressure level, the needle check valve will shift against the needle spring and open the injection holes in a nozzle tip. The fuel will then be injected into the combustion chamber of the engine.

To end the injection cycle, the driver will deliver a current or voltage to a closed side of a closed coil solenoid. The magnetic force generated in the closed coil solenoid will then shift the spool into the closed or start position which, in turn, will close the working ports of the control valve body. The working fluid pressure will then drop in the intensifier and high-pressure chamber such that the needle spring will shift the needle to the closed position. The nozzle tip, at this time, will close the injection holes and end the fuel injection process. At this stage, the working fluid is then vented from the fuel injector via vent holes surrounding the control valve body.

Referring now to FIG. 1A, in current designs the vent holes 10 surround the control valve body 12 and the spool 14 such that air 16 in the control valve body 12 is below the working fluid level 18. This causes the grooves 20 of the control valve body 12 and the spool 14 to be filled with air 16. Now, during the next cycle time (as seen in FIG. 1B) when the spool 14 is shifted to the open position, this air 16 becomes locked within the grooves 20 causing air bubbles 22 to be formed within the working fluid 18 of the working ports 23. In order to inject fuel within the combustion chamber, this captured air will have to be compressed by the working fluid and dissolved partially into a dilution prior to the working fluid acting on the intensifier piston. This causes a shot to shot fuel variation (depending on the quantity of air in the working fluid) thus resulting in decreased fuel efficiency especially for low fuel quantities.

The present invention is directed to overcoming one or more of the problems as set forth above.

SUMMARY OF THE INVENTION

In a first aspect of the present invention, a check valve body has an inlet area and a working port in fluid communication with the inlet area. The working port is adapted to provide working fluid to an intensifier chamber of the fuel injector. At least one communication port is in fluid communication with the inlet area and the working port. At least one vent hole is provided which prevent air from mixing with the working fluid.

In another aspect of the present invention, the check valve body has an oil inlet area and a at least one port in fluid communication with the oil inlet area. The port transport oil between the oil inlet area and an intensifier chamber of the fuel injector. An aperture having at least one communication port provides a flow path for the oil between the ports and the oil inlet area. A spool is positioned within the aperture and includes at least one fluid path which are in alignment with the communication port of the aperture when the spool is in the first position. Vent ports vent the oil from the control valve body and prevent air from entering the at least one fluid path of the spool.

In still another aspect of the present invention, a fuel injector having a control body is provided. The control body has an inlet area, working ports, communication ports and fluid paths, a spool and at least one vent hole. The at least one vent hole is positioned above the working ports to reduce captured air in the working ports during a venting process. The fuel injector also includes an intensifier body and a spring loaded piston and plunger within a centrally located bore of the intensifier body. A high pressure fuel chamber is also formed in the intensifier body. A nozzle having a fuel bore is in fluid communication with the high pressure chamber, and a needle is positioned within the nozzle. A fuel chamber surrounds the needle.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The present invention is directed to an oil activated electronically, mechanically or hydraulically controlled fuel injector which is capable of substantially decreasing and/or preventing captured air from mixing with the working fluid such as, for example, hydraulic oil, during the fuel injection process. The oil activated fuel injector of the present invention will also avoid capturing of air in the control valve body as well as grooves or orifices positioned in either a spool or the control valve body, itself. The present invention is also capable of decreasing shot to shot variations in fuel injection at low fuel quantities thus increasing the predictability of the fuel injector throughout a range of hydraulic oil pressures. This increased predictability also leads to increased fuel efficiency even at lower fuel quantities.

Embodiments of the Oil Activated Fuel Injector of the Present Invention

Figure 1B:
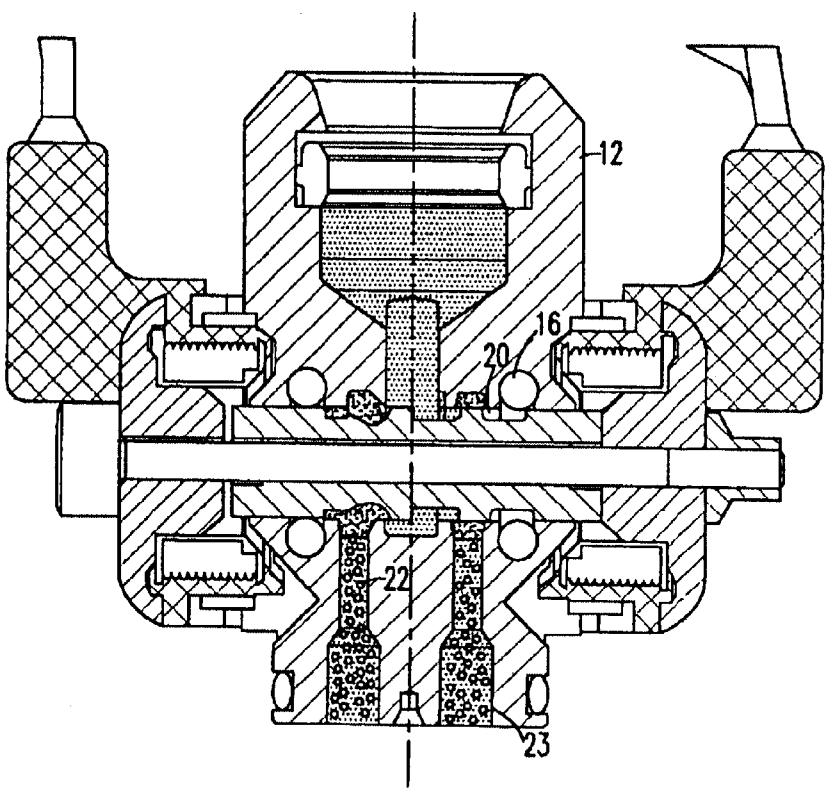
FIG. 1B PRIOR ART
FIG. 1B shows a conventional control valve body with air bubbles in the working fluid.
Figure 1A:
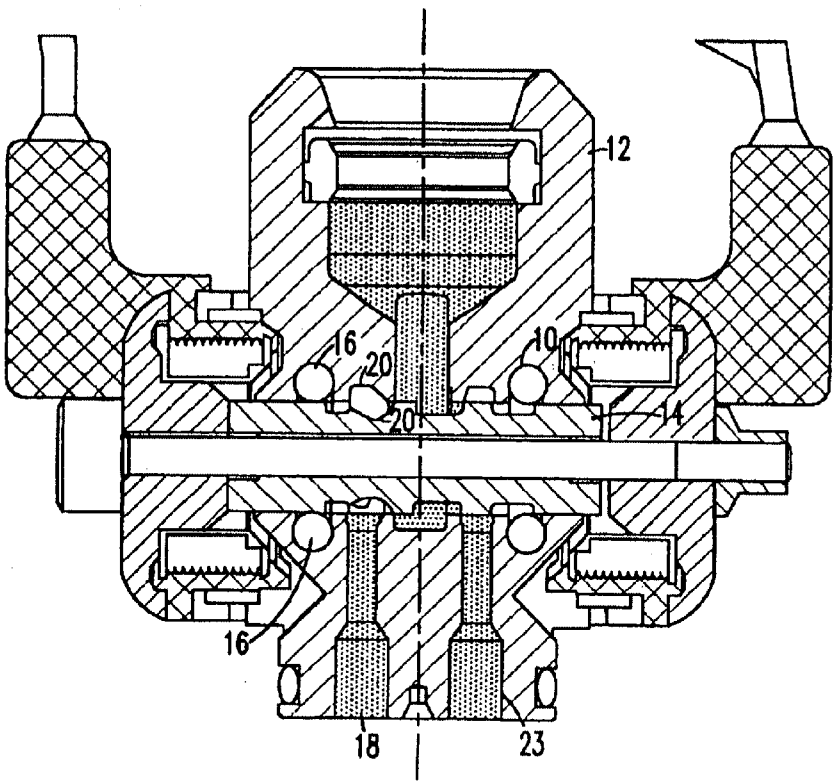
FIG. 1A PRIOR ART
FIG. 1A shows a conventional control valve body of an oil activated fuel injector with captured air in vent holes and grooves.
Figure 2:
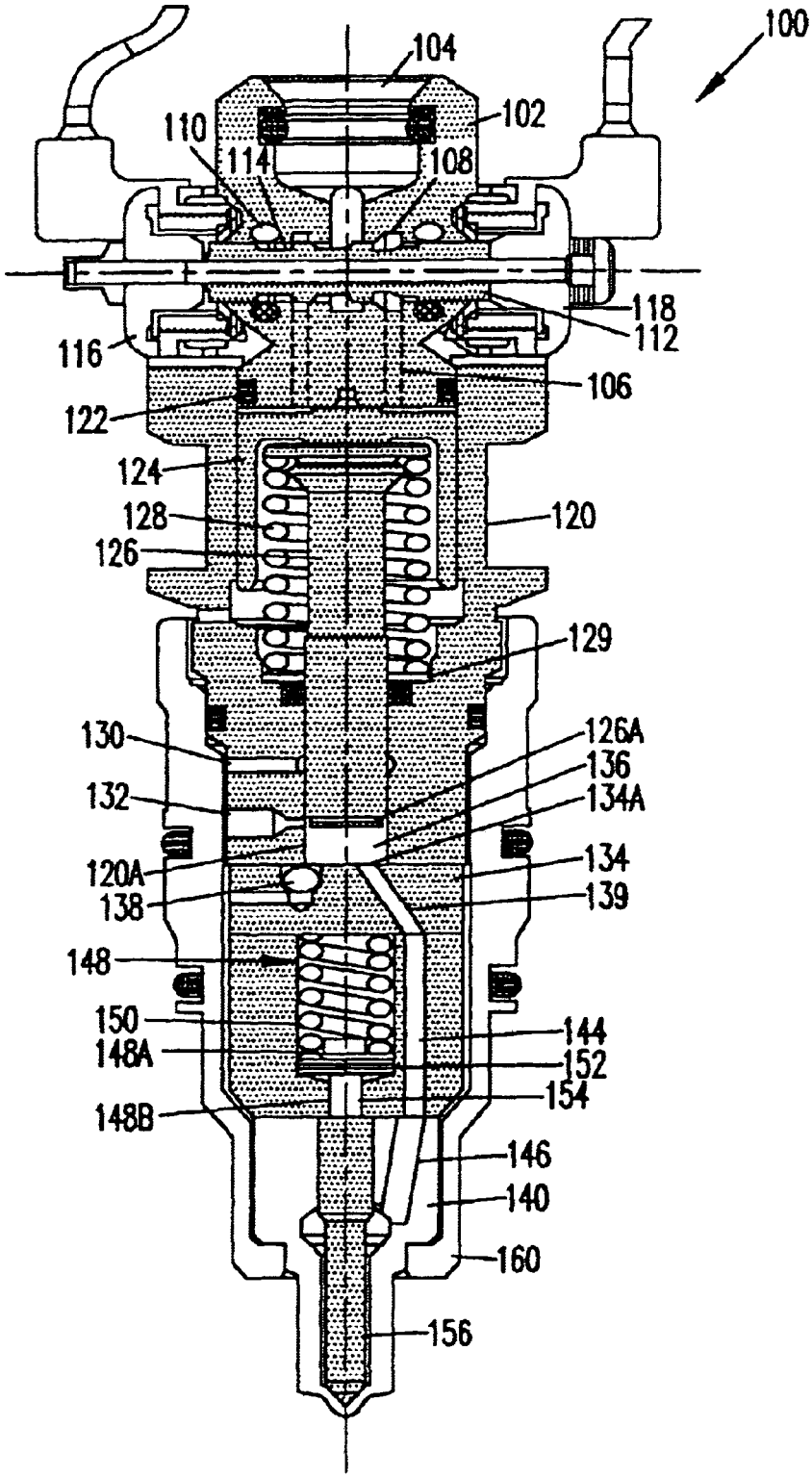
FIG. 2 shows an oil activated fuel injector of the present invention.

Referring now to FIG. 2, an overview of the fuel injector of the present invention is shown. The fuel injector is generally depicted as reference numeral 100 and includes a control valve body 102 as well as an intensifier body 120 and a nozzle 140. The control valve body 102 includes an inlet area 104 which is in fluid communication with working ports 106. At least one groove or orifice (hereinafter referred to as grooves) 108 are positioned between and in fluid communication with the inlet area 104 and the working ports 106. At least one of vent hole 110 (and preferably two ore more) is located in the control body 102 which are in fluid communication with the working ports 106. In the embodiments of the present invention, the vent holes 110 are arranged or designed to eliminate or substantially reduce captured air in the working fluid within the working ports 106.

A spool 112 having at least one groove or orifice (hereinafter referred to as grooves) 114 is slidably mounted within the control valve body 102. An open coil 116 and a closed coil 118 are positioned on opposing sides of the spool 112 and are energized via a driver (not shown) to drive the spool 112 between a closed position and an open position. In the open position, the grooves 114 of the spool 112 are aligned with the grooves 108 of the valve control body 102 thus allowing the working fluid to flow between the inlet area 104 and the working ports 106 of the valve control body 102.

Still referring to FIG. 2, the intensifier body 120 is mounted to the valve control body 102 via any conventional mounting mechanism. A seal 122 (e.g., o-ring) may be positioned between the mounting surfaces of the intensifier body 120 and the valve control body 102. A piston 124 is slidably positioned within the intensifier body 120 (e.g. intensifier chamber) and is in contact with an upper end of a plunger 126. An intensifier spring 128 surrounds a portion (e.g., shaft) of the plunger 126 and is further positioned between the piston 124 and a flange or shoulder 129 formed on an interior portion of the intensifier body 120. The intensifier spring 128 urges the piston 122 and the plunger 126 in a first position proximate to the valve control body 102. A plurality of venting and pressure release holes 130 and 132, respectively, are formed in the body of the intensifier body 120. The plurality of venting and pressure release holes 130 and 132 are further positioned adjacent the plunger 126.

A check disk 134 is positioned below the intensifier body 120 remote from the valve control body 102. The combination of an upper surface 134*a* of the check disk 134, an end portion 126*a* of the plunger 126 and an interior wall 120*a* of the intensifier body 120 forms a high pressure chamber 136. A fuel inlet check valve 138 is positioned within the check disk 134 and provides fluid communication between the high pressure chamber 136 and a fuel area (not shown). This fluid communication allows fuel to flow into the high pressure chamber 136 from the fuel area during an up-stroke of the plunger 126. The pressure release hole 132 is also in fluid communication with the high pressure chamber 136 when the plunger 126 is urged into the first position; however, fluid communication is interrupted when the plunger 126 is urged downwards towards the check disk 134. The check disk 134 also includes an angled fuel bore 139 in fluid communication with the high pressure chamber 136.

FIG. 2 further shows the nozzle 140 and a spring cage 142. The spring cage 142 is positioned between the nozzle 140 and the check disk 134, and includes a straight fuel bore 144 in fluid communication with the angled fuel bore 139 of the check disk 134. The spring cage 142 also includes a centrally located bore 148 having a first bore diameter 148*a* and a second smaller bore diameter 148*b*. A spring 150 and a spring seat 152 are positioned within the first bore diameter 148*a* of the spring cage 142, and a pin 154 is positioned within the second smaller bore diameter 148*b*.

The nozzle 140 includes a second angled bore 146 in alignment with the straight bore 139 of the spring cage 142. A needle 150 is preferably centrally located with the nozzle 140 and is urged downwards by the spring 150 (via the pin 154). A fuel chamber 152 surrounds the needle 150 and is in fluid communication with the angled bore 146. In embodiments, a nut 160 is threaded about the intensifier body 120, the check disk 134, the nozzle 140 and the spring cage 142.

Figure 3B:
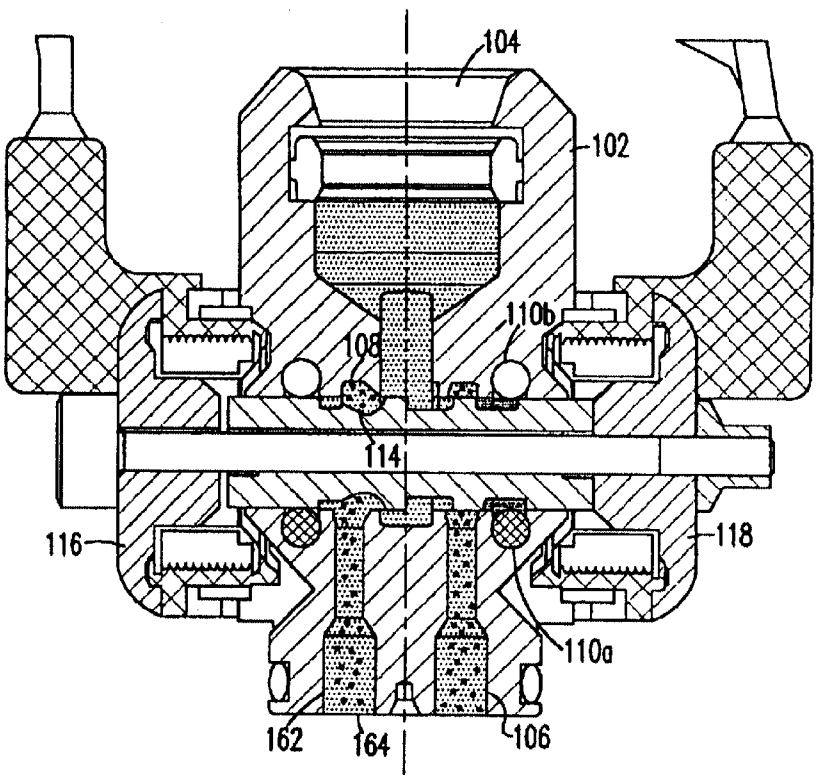
FIG. 3B shows the control valve body of the present invention with the spool in the open position.
Figure 3A:
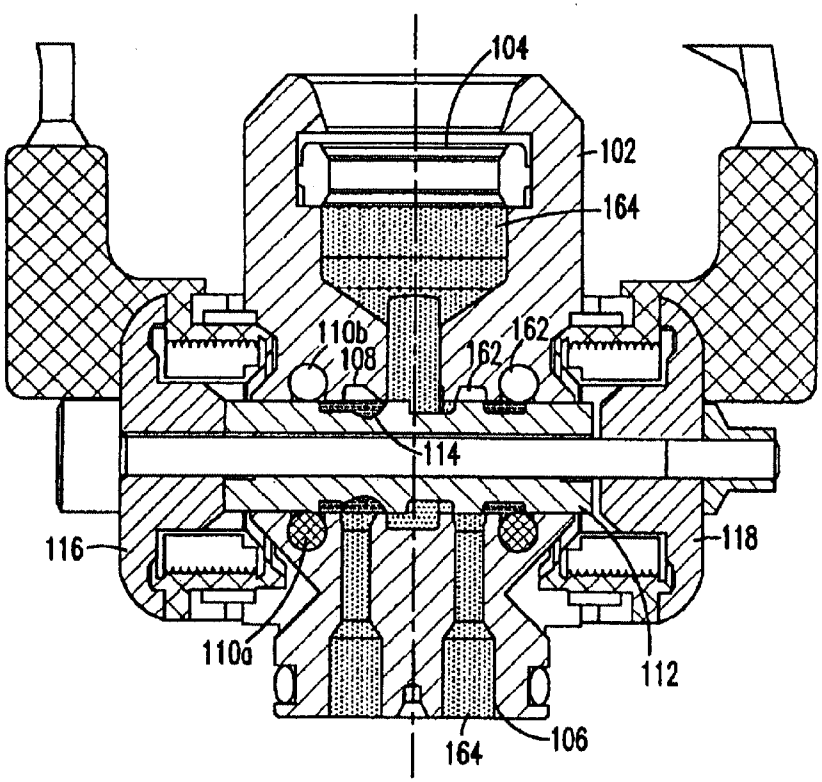
FIG. 3A shows a control valve body of the oil activated fuel injector of the present invention with a spool in a closed position.

FIG. 3A shows the control valve body 102 of FIG. 2 with the spool 112 in the closed or start position. In FIG. 3A, the lower vent holes 110*a* are plugged or capped to ensure that air 162 remains above the working fluid level 164 during the venting process. Alternatively, the lower vent holes 110*a* may be entirely eliminated from the valve control body 102. In these embodiments, the working fluid 164 rises to a level of the upper vent holes 110*b* during the venting process. The working fluid 164 also fills the grooves 114 of the spool 112; however, air 162 may remain in the upper portion of the grooves 108 and the upper vent holes 110*b* of the valve control body 102. In this configuration, the air in the upper vent holes 110*b* and upper portion of the grooves 108 is above the level of the working fluid 164. In the closed position of FIG. 3A, the working fluid 164 within the inlet area 104 will not flow to the working ports 106 due to the non-alignment of the grooves 108 and 114.

FIG. 3B shows the control body 102 with the spool 112 in an open position. In the open position of the spool 112, the grooves 108 of the valve control body 102 and the grooves 114 of the spool 112 are in alignment with one another thus allowing the working fluid 164 to flow from the inlet area 104 to the working ports 106. As seen from FIG. 3B, during the flow of working fluid 164 only a small amount of air is captured and locked in the grooves 108. Accordingly, only a small amount of air 162 is then captured in the working fluid 164. This is because the air 162 remains above the working fluid level 164 when the spool 112 is in the closed position (FIG. 3A). Thus, only a small amount of captured air will have to be compressed and dissolved by the working fluid thus greatly minimizing shot to shot fuel variations especially for low fuel quantities.

Figure 4B:
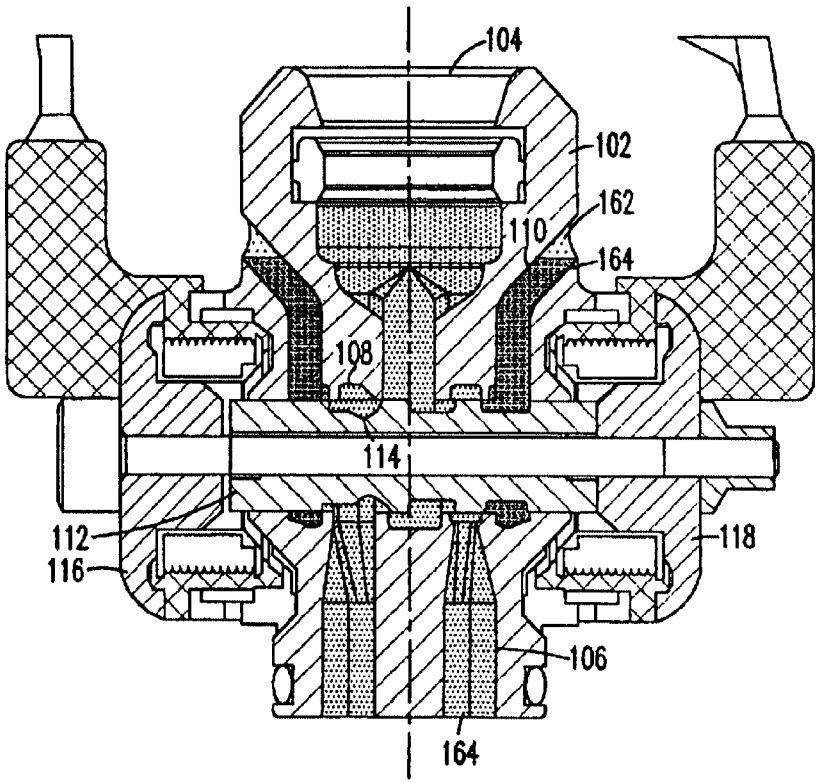
FIG. 4B shows the second embodiment of the control valve body of the present invention with the spool in the open position.
Figure 4A:
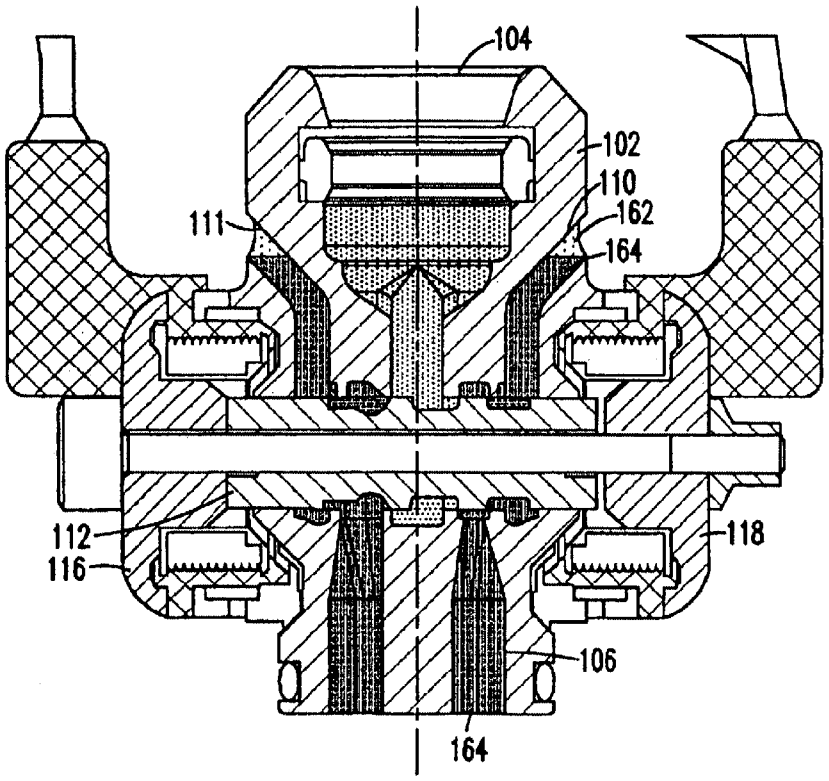
FIG. 4A shows a second embodiment of the control valve body of the present invention with the spool in the closed position.

FIG. 4A shows a second embodiment of the control valve body 102 with the spool 112 in the closed position. In this embodiment, the vent holes 110 include an inlet 111 which is positioned above the grooves 108 of the valve control body 102 and the grooves 114 of the spool 112. The position of the inlet 111 of the vent holes 110 will not permit air to fill the grooves 108 and 114. This is because the position of the vent holes 110 is positioned such that the working fluid 164 will remain in the vent holes 110 during and after the venting process, and air 162 will thus be prevented from entering the grooves 108 and 114. That is, the air 164 will always remains above the grooves 108 and 114. Now, when the spool 112 is in the closed position and the venting process begins it is not possible for the air 162 to enter the grooves 108 of the valve control body 102 and the grooves 114 of the spool 112. Thus, as seen in FIG. 4B, the working fluid 164 will flow between the inlet 104 and the working ports 106 of the valve control body 102 without any captured air therein.

Figure 5:
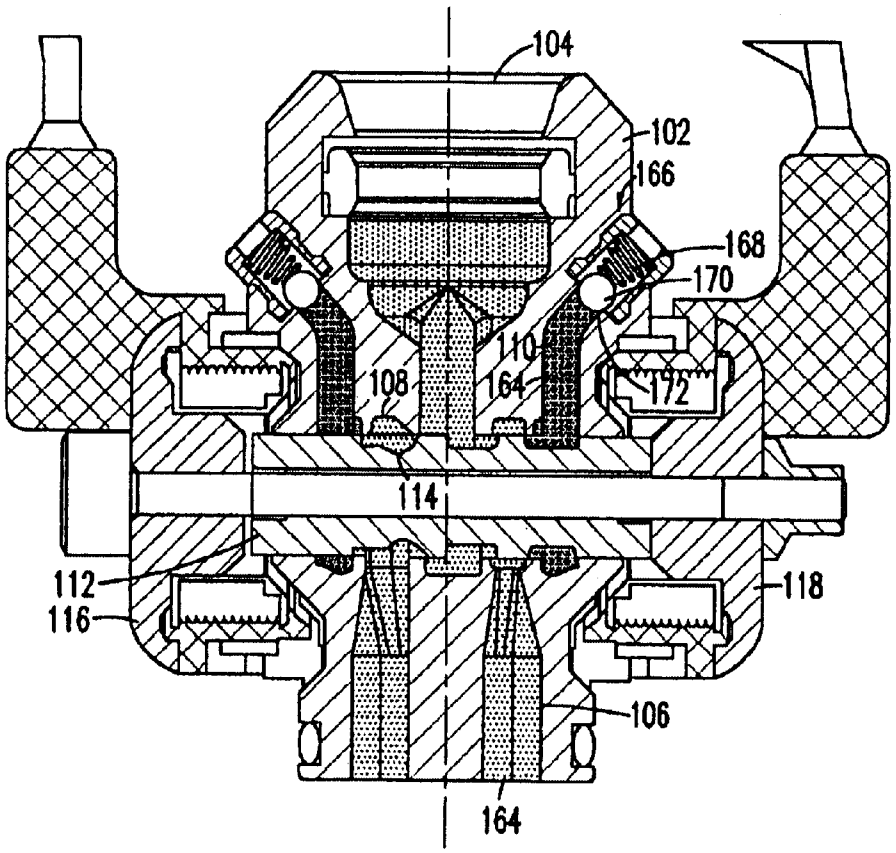
FIG. 5 shows a third embodiment of the control valve body of the present invention.

FIG. 5 shows an embodiment of the control valve body 102 of FIGS. 4A and 4B. In this embodiment, the vent holes 110 include a check valve 166. The check valve 166 includes a spring 168 which biases a ball, plate or cone 170 against a seat 172. The vent holes may face downward due to the use of the check valve 166. During the venting process, the working fluid 164 overcomes a spring force of the spring 168 and thus disengages the ball 170 from the seat 172. This allows the working fluid 164 to vent from the vent holes 110 during the venting process. When the spool 112 is in the open position or venting stops, the ball 170 will be biased against the seat 172 and will prevent air from entering the system. In this manner, when the spool 112 is in the closed position and the venting process begins it is not possible for air 162 to enter or become locked in the grooves 108 or 114. In this arrangement, air 162 will not be mixed with the working fluid 164 thus ensuring more consistent fuel consumption predictability and efficiency.

Figure 6:
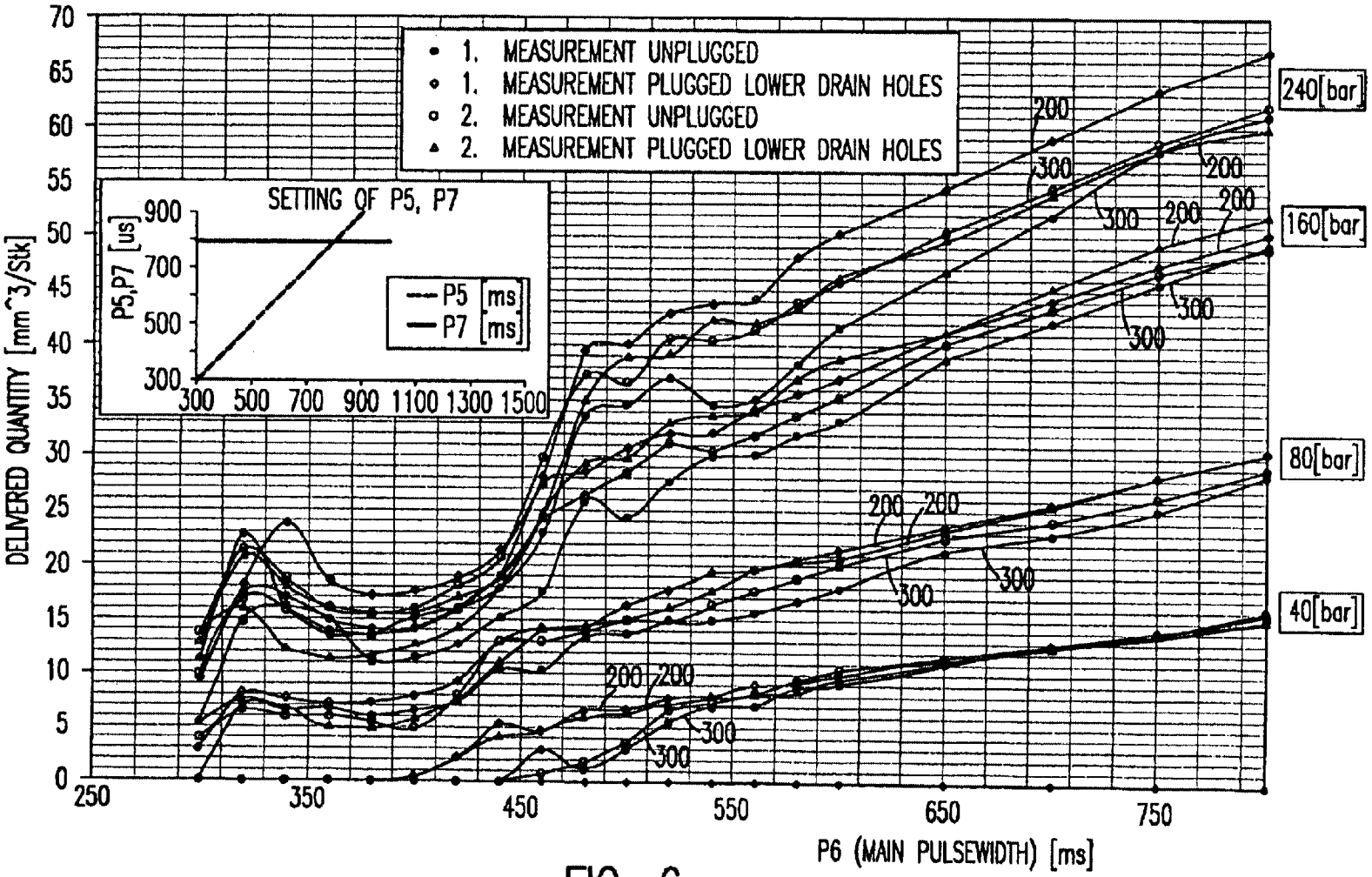
FIGS. 6–10 show performance charts of the oil activated fuel injector of the present invention.
Figure 9:
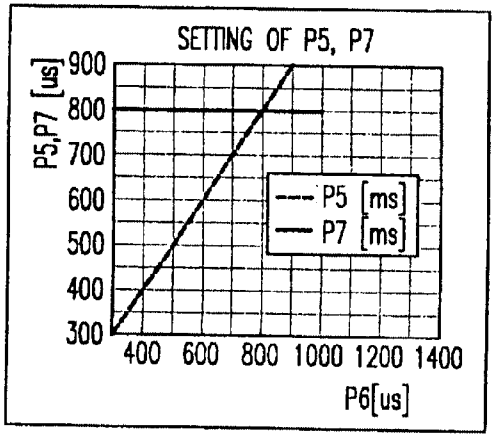
Figure 9:
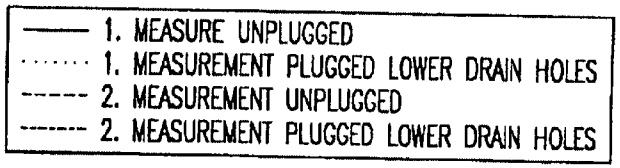
Figure 9:
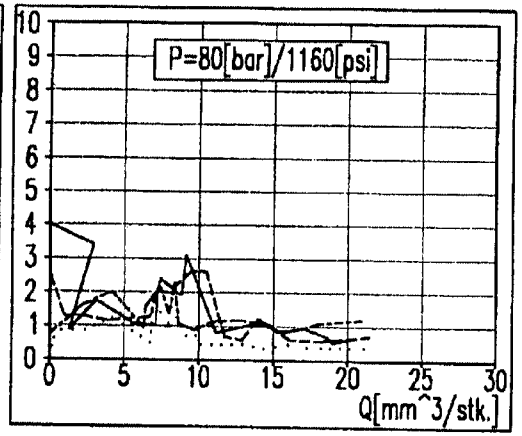
Figure 8:
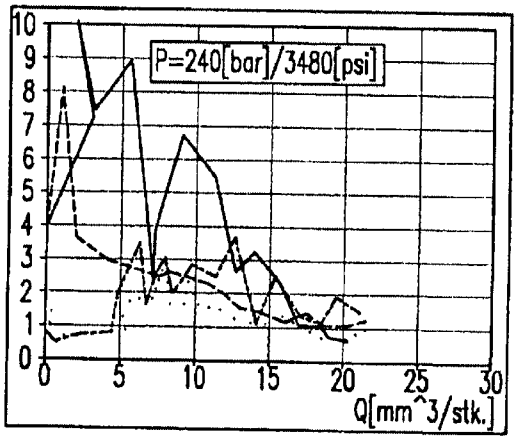
Figure 10:
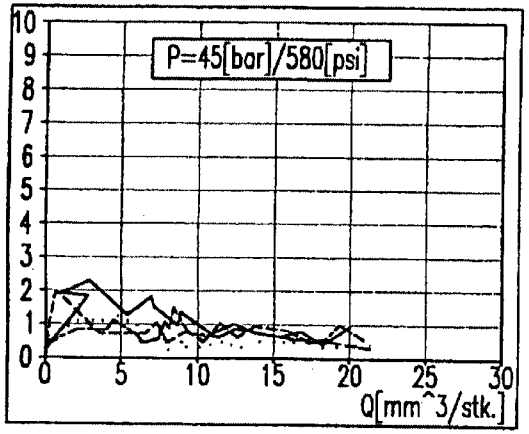
Figure 7:
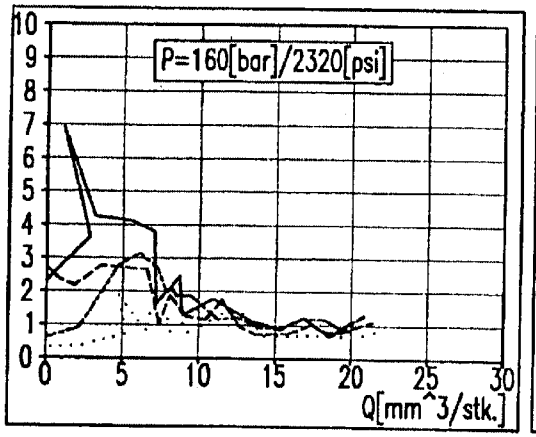

FIG. 6 shows a chart depicting several tests of a conventional fuel injector (of known design) and the oil activated fuel injector of FIGS. 2–3B at several different testing pressures. The lines 200 depict the results relating to the oil activated fuel injector of the present invention and lines 300 depict the results of the conventional fuel injector. The test parameters included:

1. Engine speed: 1000 RPM
2. Pump speed: 1000 RPM
3. Engine Oil Temperature: approximately 93° Celsius
4. Calibration Fluid Temperature: approximately 40° Celsius.

FIG. 6 clearly shows that the performance of the oil activated fuel injector of the present invention is superior to that of a conventional fuel injector (i.e., a fuel injector which does not prevent air from mixing with the working fluid) throughout a range of testing pressures. The superior performance of the oil activated fuel injector of the present invention is shown to be even greater at higher operating pressures such as, for example, 160 bars. This superior performance is attributed to the fact that the oil activated fuel injector of the present invention substantially prevents and, in embodiments, completely eliminates the mixing of air with the working fluid. This is a direct result of the placement and/or design of the vent holes 110 of the control valve body 102.

FIGS. 7–10 also show the superior performance of the oil activated fuel injector of the present invention compared to a conventional fuel injector. FIGS. 7–10 use the same test parameters of FIG. 6.

Operation of the Oil Activated Fuel Injector of the Present Invention

In operation, a driver (not shown) will first energize the open coil 116. The energized open coil 116 will then shift the spool 112 from a start position to an open position. In the open position, the grooves 108 of the control valve body 102 will become aligned with the grooves 114 on the spool 112. The alignment of the grooves 108 and 114 will allow the pressurized working fluid to flow from the inlet area 104 to the working ports 106 of the control valve body 102. As discussed in greater detail below, the placement and/or design of the vent holes 110 of the control valve body 102 will eliminate the mixing of air with the working fluid.

Once the pressurized working fluid is allowed to flow into the working ports 106 it begins to act on the piston 124 and the plunger 126. That is, the pressurized working fluid will begin to push the piston 124 and the plunger 126 downwards thus compressing the intensifier spring 128. As the piston 124 is pushed downward, fuel in the high pressure chamber will begin to be compressed via the end portion 126*a* of the plunger. The compressed fuel will be forced through the bores 139, 144 and 146 and into the chamber 158 which surrounds the needle 156. As the plunger 126 is pushed downward, the fuel inlet check valve 138 prevents fuel from flowing into the high pressure chamber 136 from the fuel area. As the pressure working ports 106 increases, the fuel pressure will rise above a needle check valve opening pressure until the needle spring 148 is urged upwards. At this stage, the injection holes are open in the nozzle 140 thus allowing fuel to be injected into the combustion chamber of the engine.

To end the injection cycle, the driver will energize the closed coil 118. The magnetic force generated in the closed coil 118 will then shift the spool 112 into the closed or start position which, in turn, will close the working ports 106 of the control valve body 102. That is, the grooves 108 and 114 will no longer be in alignment thus interrupting the flow of working fluid from the inlet area 104 to the working ports 106. At this stage, the needle spring 150 will urge the needle 156 downward towards the injection holes of the nozzle 140 thereby closing the injection holes. Similarly, the intensifier spring 128 urges the plunger 126 and the piston 124 into the closed or first position adjacent to the valve control body 102. As the plunger 126 moves upward, the pressure release hole 132 will release pressure in the high pressure chamber 136 thus allowing fuel to flow into the high pressure chamber 136 (via the fuel inlet check valve 138). Now, in the next cycle the fuel can be compressed in the high pressure chamber 136.

As the plunger 126 and the piston 124 move towards the valve control body 102, the working fluid will begin to be vented through the vent holes 110 of the present invention. This is due to the narrowing space between the piston 124 and the valve control body 102. As now discussed below, the vent holes 110 are arranged or designed to eliminate or substantially reduce captured air in the working fluid within the working ports 106.

In the embodiment of FIGS. 3A and 3B, the lower vent holes 110*a* are plugged or capped to ensure that air remains above the working fluid level during the venting process. Alternatively, the lower vent holes 110*a* may be entirely eliminated from the valve control body 102. In this embodiment, the working fluid rises to a level of the upper vent holes 110*b* during the venting process. The working fluid also fills the grooves 114. Any air in the system such as, for example, in the upper vent holes 110*b* and an upper portion of the grooves 108 is above the level of the working fluid. In this arrangement, during the next cycle when the spool 112 is opened, only a small amount of air is locked in the grooves 108 and is captured in the working fluid. This is because the air remains above the working fluid level when the spool 112 is in the closed position. Thus, only a small amount of captured air will have to be compressed and dissolved by the working fluid thus greatly minimizing shot to shot fuel variation.

In the embodiment of FIGS. 4A and 4B, the inlet 111 of the vent holes 110 are positioned above the grooves 108 of the valve control body 102 and the grooves 114 of the spool 112. This position will not permit air to fill the grooves 108 and 114 during the venting process since any air in the vent holes will now always remain above the grooves 108 and 114. In the configuration of FIGS. 4A and 4B, when the spool 112 is again opened the working fluid will flow between the inlet area 104 and the working ports 106 of the valve control body 102 without any captured air therein.

As to the embodiment of FIG. 5, the vent holes 110 include a check valve 166 which prevents air from entering the system during the venting process. Thus, when the spool 112 is in the closed position and the venting process begins it is not possible for air to enter or become locked in the grooves 108 or 114. This ensures that no air will be locked in the grooves 108 and 114 and mix with the working fluid thus providing for more efficient fuel consumption.

While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. A control valve body adapted for use with a fuel injector, comprising:

an inlet area;

working ports in fluid communication with the inlet area, the working ports for providing working fluid to an intensifier chamber of the fuel injector;

at least one communication port in fluid communication with the inlet area and the working ports; and at least one vent hole in fluid communication with the working ports, the at least one vent hole preventing air from entering the working ports and mixing with the working fluid.

2. The control valve body of claim 1, wherein the at least one vent hole includes at least one upper vent hole positioned above the working ports.

3. The control valve body of claim 2, wherein the at least one vent hole includes at least one lower vent hole positioned below a level of the working fluid, the at least one lower vent hole being plugged or capped to prevent venting of the working fluid from the at least one lower vent hole.

4. The control valve body of claim 1, wherein the at least one vent hole has an inlet which is positioned above the at least one communication port.

5. The control valve body of claim 4, wherein the working fluid remains within the at least one vent hole which will prevent air from entering the working ports and mixing with the working fluid therein.

6. The control valve body of claim 1, further comprising a check valve positioned within the at least one vent hole, the check valve allowing working fluid to be vented to a drain and preventing air from entering the working ports.

7. The control valve body of claim 6, wherein the check valve includes one of a ball, plate and cone, the check valve further including a spring, the spring urges the ball, plate or cone against a seat located within the at least one vent hole.

8. The control valve body of claim 6, wherein the at least one vent hole faces downward.

9. The control valve body of claim 1, wherein the at least one communication port is two or more communication ports.

10. The control valve body of claim 1, wherein the at least one communication port is one of an orifice and a groove.

11. The control valve body of claim 1, further comprising a spool having at least one communication port, the spool being slidable between a first position and a second position, the at least one communication port of the spool and the at least one communication port being in alignment when the spool is in the first position, the at least one vent hole preventing air from entering the at least one communication port of the spool.

12. The control valve body of claim 11, wherein the at least one communication port of the spool is one of a groove and an orifice and air is prevented from being locked in the groove or orifice of the spool.

13. The control valve body of claim 1, wherein the at least one communication port is two or more communication ports.

14. A control valve body for use with a fuel injector, comprising:

an oil inlet area;

at least one port in fluid communication with the oil inlet area, the at least one port transporting oil between the oil inlet area and an intensifier chamber of the fuel injector;

an aperture having at least one communication port positioned about a surface of the aperture, the at least one communication port providing a flow path for the oil between the at least one port and the oil inlet area;

a spool positioned within the aperture and slideable between a first position and a second position, the spool including at least one communication port which is in alignment with the at least one communication port of the aperture when the spool is in the first position; and at least one vent port for venting the oil from the control valve body when the spool is in the second position, the at least one vent port being positioned above a level of the oil and preventing air from entering the at least one communication port of the spool.

15. The control valve body of claim 14, wherein the at least one vent port includes an inlet above the at least one communication port of the spool and the aperture.

16. The control valve body of claim 15, further including a check valve positioned at the inlet of the at least one vent port.

17. The control valve body of claim 15, wherein the check valve includes one of a ball, plate and cone and a spring mechanism, wherein the spring urges the ball, plate or cone against a seat of the check valve after a venting of the oil.

18. The control valve body of claim 14, wherein the at least one vent hole includes an upper set of vent holes and a lower set of vent holes, the upper set of vent holes being positioned above the oil and the lower set of vent holes being capped or plugged.

19. The control valve body of claim 14, wherein the at least one communication port of the aperture and the spool is one of a groove and an orifice.

20. An oil activated fuel injector, comprising:

a control valve body, the control body including:

an inlet area;

at least one working port in fluid communication with the inlet area;

at least one communication port positioned between and in fluid communication with the inlet area and the at least one working port;

a spool having at least one fluid path which is alignable with the at least one communication port;

at least one vent hole in fluid communication with the at least one working port, the at least one vent hole being positioned above the at least one working port to reduce captured air in the at least one working port;

an intensifier body mounted to the control valve body, the intensifier body including a centrally located bore and a shoulder;

a piston slidably positioned within centrally located bore of the intensifier body;

a plunger contacting the piston, the plunger having a first end, a second end and a shaft;

an intensifier spring surrounding the shaft of the plunger and further positioned between the piston and the shoulder of the intensifier body, the intensifier spring urging the piston and the plunger in a first position proximate to the valve control body;

a high pressure fuel chamber formed at the second end of the plunger;

a nozzle having a fuel bore in fluid communication with the high pressure chamber;

a needle positioned within the nozzle; and a fuel chamber surrounding the needle and in fluid communication with the fuel bore.

21. The fuel injector of claim 20, wherein the at least one vent hole has an inlet which is positioned above the at least one fluid path of the spool.

22. The fuel injector of claim 21, wherein working fluid remains within the at least one vent hole which eliminates air from entering the at least one working port and mixing with the working fluid therein.

23. The fuel injector of claim 21, further comprising a check valve positioned within the at least one vent hole, the check valve allowing working fluid to be vented to a drain and preventing air from entering the at least one working port.

24. The fuel injector of claim 20, wherein the at least one vent hole includes an upper set of vent holes and a lower set of vent holes, the upper set of vent holes being positioned above working fluid in the at least one working port and the lower set of vent holes being capped or plugged.

25. The fuel injector of claim 20, further comprising:

a check disk positioned below the intensifier body remote from the valve control body, wherein a combination of an upper surface of the check disk, the second end of the plunger and an interior wall of the intensifier body forms the high pressure chamber; and a fuel bore in fluid communication with the fuel bore of the nozzle.

26. The fuel injector of claim 25, further comprising a fuel inlet check valve positioned within the check disk and providing fluid communication between the high pressure chamber and a fuel area during an upstroke of the plunger.

27. The fuel injector of claim 26, further comprising a spring cage positioned between the nozzle and the check disk, the spring cage including a spring which is in biasing contact with the needle.

* * * * *